US006750760B2

(12) United States Patent
Albritton et al.

(10) Patent No.: US 6,750,760 B2
(45) Date of Patent: Jun. 15, 2004

(54) DOOR CHIME ASSEMBLY AND METHOD

(75) Inventors: Charles W. Albritton, Germantown, WI (US); William A. Kaepernick, Fox Lake, WI (US); Daniel L. Karst, Beaver Dam, WI (US); Robb R. Roell, West Bend, WI (US); Richard G. McDonald, Plymouth, WI (US)

(73) Assignee: Broan-NuTone, Hartford, WI (US)

( * ) Notice: Subject to any disclaimer, the term of this patent is extended or adjusted under 35 U.S.C. 154(b) by 0 days.

(21) Appl. No.: 09/998,954

(22) Filed: Nov. 15, 2001

(65) Prior Publication Data

US 2003/0090369 A1 May 15, 2003

(51) Int. Cl.[7] ..... G08B 3/00

(52) U.S. Cl. ..... 340/392.1; 340/392.4; 340/396.1; 340/815.48; 340/815.79; 340/815.83; 340/330

(58) Field of Search ..... 340/392.1, 392.2, 340/393.2, 393.3, 392.4, 392.5, 396.1, 404.1, 404.2, 330, 328, 815.48, 815.49, 815.79, 815.83

(56) References Cited

U.S. PATENT DOCUMENTS

| | | | | | |
|---|---|---|---|---|---|
| 2,757,633 | A | | 8/1956 | Roseman | |
| 2,850,724 | A | | 9/1958 | Bassani | |
| 2,856,890 | A | | 10/1958 | Rinker | |
| 3,012,538 | A | | 12/1961 | Roseman | |
| 4,005,341 | A | * | 1/1977 | Uptegraff, Jr. et al. | 361/38 |
| 4,110,750 | A | * | 8/1978 | Heyning et al. | 340/384 |
| 4,488,272 | A | * | 12/1984 | Scott, Jr. | 368/75 |
| 4,567,846 | A | | 2/1986 | Kurtz | |
| 5,420,564 | A | * | 5/1995 | Remington | 340/392.1 |
| 5,652,568 | A | | 7/1997 | Ko | |
| 5,659,286 | A | | 8/1997 | Lin | |
| 5,748,074 | A | * | 5/1998 | Chomet | 340/328 |
| 5,774,041 | A | * | 6/1998 | Xydis et al. | 340/396.1 |
| 5,969,627 | A | | 10/1999 | Tarlton | |
| 6,028,504 | A | | 2/2000 | Segan | |
| 6,127,935 | A | | 10/2000 | Davidson et al. | |
| 6,395,979 | B1 | * | 5/2002 | English | 174/50 |

* cited by examiner

*Primary Examiner*—Jeffery Hofsass
*Assistant Examiner*—Daniel Prévil
(74) *Attorney, Agent, or Firm*—Michael Best & Friedrich LLP

(57) ABSTRACT

Some embodiments of the present invention enable a user to select from different appearances and sound types by providing different door chime assembly housing covers. The housing covers can be different in shape, size, appearance, and/or acoustic property, and preferably can be releasably mounted a housing base. A door chime assembler, manufacturer, or user can therefore select from different door chime assembly appearances and acoustic properties by selecting one of two or more different housing covers. The door chime assembly can employ a number of different features that change the sound quality of the door chime assembly, including a domed or tented housing cover shape, a housing cover having curved edges and corners, an open acoustic chamber unbroken by internal walls, and side wall housing apertures. Other significant advantages are provided by the use of a door chime assembly transformer that is mounted to the door chime assembly housing.

45 Claims, 7 Drawing Sheets

DOOR CHIME ASSEMBLY AND METHOD

FIELD OF THE INVENTION

The present invention relates to signaling devices, and more particularly to door chimes and methods of manufacturing door chimes.

BACKGROUND OF THE INVENTION

A wide variety of door chime assemblies have been available for decades, each offering any number of aesthetic and functional features to attract customers. Unfortunately, a result of such a wide variety is a lack of standardization in the industry and even within product lines. While not normally a problem per se, a lack of standardization brings with it a number of disadvantages to consumers and to manufacturers. For example, manufacturers offering different types (e.g., models, sizes, etc.) of door chime assemblies often have additional inventory for each assembly type and need separate molds and other tooling to manufacture the different assemblies. As another example, conventional door chimes cannot be readily changed in operation or appearance by a consumer or installer. Therefore, when the external appearance or the sounds made by the chimes of a door chime assembly are no longer desirable, the entire assembly must typically be replaced.

Another shortcoming of conventional door chime assemblies is related to their installation. Most commonly, electrically-powered door chime assemblies are supplied with electricity from a remotely connected transformer. Because it is desirable (and often required by electrical codes) to isolate relatively high-voltage electricity to the transformer from relatively low-voltage electricity powering striker actuators in the door chime assembly and doorbell buttons connected to the transformer, the transformer is often installed a distance from the door chime assembly and from the buttons. As a result, relatively low-voltage doorbell wiring with thin electrical insulation is commonly installed in a house or building between the doorbells and/or door chime assembly and the transformer. Such wiring can be in addition to electrical wiring already in the walls, floors, and ceilings of a house or building, and therefore represents an additional wiring process for the door chime assembly installer. Therefore, the practice of isolating a transformer (and the relatively high-voltage wiring supplying power thereto) from the rest of the door chime assembly and buttons is required by the National Electric Code and numerous other electric codes across the country, but increases installation difficulties as just described. As used herein and in the appended claims, the term "high-voltage" refers to voltage between the house or building power supply and the transformer of the subject door chime assembly, while the term "low voltage" refers to voltage between the transformer and other portions of the door chime assembly. For example, the "high voltage" power to a transformer is commonly 120 or 220 Volts in United States homes and buildings, while the "low voltage" power in a door chime assembly is less than 30 Volts, and is commonly set at 8, 16, or 24 Volts.

In addition to the above-described installation problems of conventional door chime assemblies, many door chime assemblies have mounting orientation limitations. Specifically, some door chime assemblies must be mounted in a particular orientation to operate properly. This can significantly limit an installer's options relating to door chime assembly appearance and location.

Another problem common to conventional door chime assemblies is the manner in which they are manufactured. Even relatively simple door chime assemblies have numerous parts that must be assembled, mounted and wired by a manufacturer. Increased industry competition requires that manufacturers employ door chime assembly designs enabling easy and fast door chime assembly production at minimal cost and without sacrifice of quality. However, many conventional door chime assembly designs are either too labor-intensive to profitably manufacture or are produced at significant losses.

Unfortunately, there is often little compromise between quality and ease of manufacture for conventional door chime assembly designs. Although tone quality, resonance, and volume are valuable features for any door chime assembly, a consumer must typically purchase an expensive assembly to obtain these features even though they generally have little to do with the manufacturers' assembly costs. Accordingly, an inexpensive door chime assembly with good tone quality, resonance, and volume is a rare item.

In light of the problems and limitations of the prior art described above, a need exists for a door chime assembly that reduces the amount of wiring for installation, is easier to install, can be installed in different orientations as desired, meets electrical codes by isolating or shielding high-voltage lines from low-voltage lines (as commonly required by city and other electric codes), can be readily changed to meet a user's taste, can be easily, quickly, and inexpensively manufactured, and has high-quality acoustics. Each preferred embodiment of the present invention achieves one or more of these results.

SUMMARY OF THE INVENTION

Some embodiments of the present invention enable a user to select from different appearances for a door chime assembly by providing two or more different housing covers for the door chime assembly. The housing covers can be different in shape, size, and/or appearance, and preferably can be releasably mounted to the rest of the door chime assembly, such as to a base of the door chime assembly. A door chime assembler, manufacturer, or end user can therefore select from different door chime assembly appearances by selecting one of two or more different housing covers. Each housing cover can preferably be mounted to a universal housing base. Preferably, the appearance of an existing door chime assembly (e.g., one installed by an earlier user or one matching a previous room decor) can be changed in this manner, thereby avoiding the need to purchase an entirely new door chime assembly in order to obtain a different door chime assembly appearance.

In addition or alternatively, housing covers having different internal shapes can be attached to the rest of the door chime assembly, thereby changing the type of sound generated by the door chime assembly when operated. A manufacturer, assembler, or user can therefore select from different door chime sounds by selecting one of two or more different housing covers. This avoids the need to install a different door chime assembly in order to obtain a different door chime assembly sound.

The door chime assembly according to the present invention can employ a number of different features that change and/or improve the sound quality of the door chime assembly. For example, some preferred embodiments have housing covers that are domed or tented for improved sound. The housing cover can be defined by walls extending away from a housing base and joined to a housing cover top surface by curved edges and corners. Another acoustic feature of the present invention is the use of an internal acoustic chamber that is not separated by one or more internal walls (other than structure associated with the actuator and striker assembly and the chimes and chime mounts). Also, the side walls of the housing cover preferably have apertures that enable the escape of sound from the door chime assembly. Preferably, an aperture is located adjacent to each chime in the door chime assembly, and can be located along a face of the chime rather than an edge or end thereof in order to provide improved acoustics. For this purpose also, some embodiments of the present invention have chimes located adjacent to the side wall apertures and between the apertures and the center of the acoustic chamber.

Other significant advantages of the present invention are provided by the use of a door chime assembly transformer that can be mounted to the door chime assembly housing. By employing such an arrangement, the door chime assembly and transformer can be assembled and conveniently installed as a single integral unit in which low voltage wiring is separated by high voltage wiring in order to meet electrical codes. This feature simplifies door chime assembly and wiring, and therefore significantly shortens the time needed to install a door chime assembly.

In addition, some preferred embodiments of the present invention employ an actuator and striker assembly that permits the door chime assembly to be mounted in any orientation desired. This flexibility increases the options for door chime appearance and mounting location. To further enhance its appearance, the chime can be left in its natural state or can be painted to match the décor.

More information and a better understanding of the present invention can be achieved by reference to the following drawings and detailed description.

BRIEF DESCRIPTION OF THE DRAWINGS

The present invention is further described with reference to the accompanying drawings, which show a preferred embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF THE PREFERRED EMBODIMENTS

Figure 1:
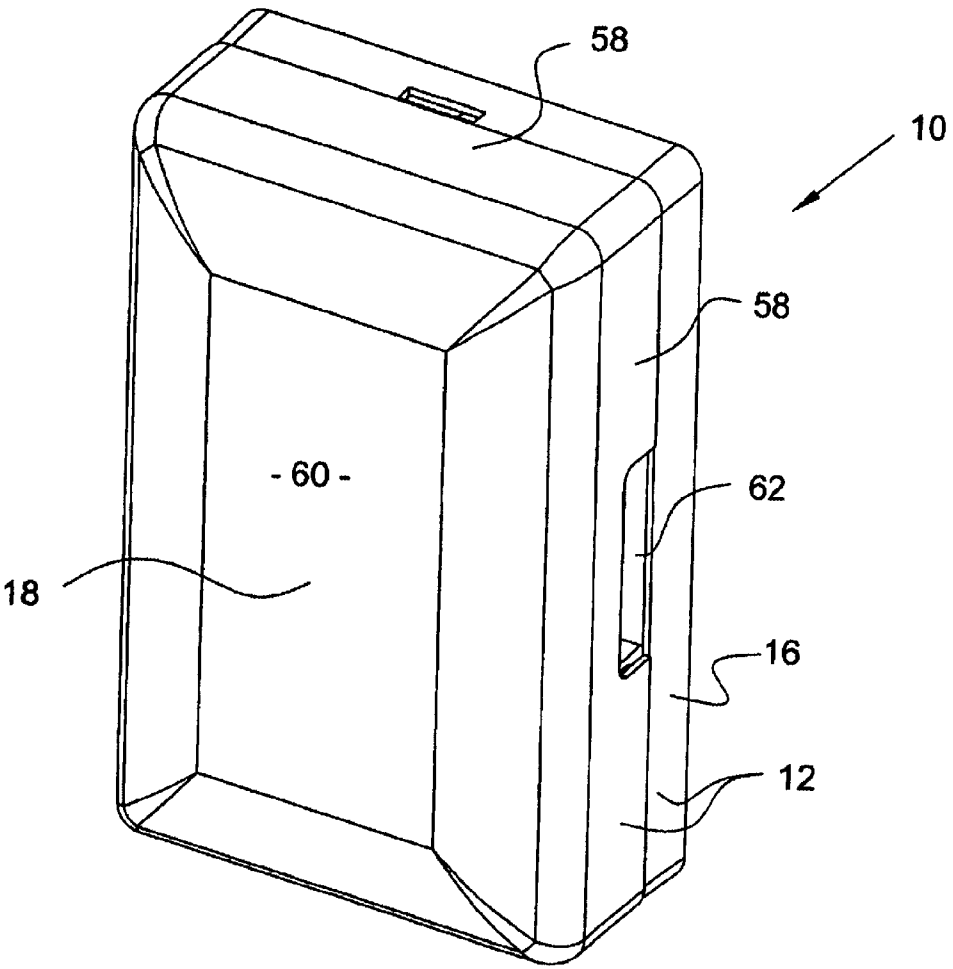
FIG. 1 is a front perspective view of a door chime assembly according to a preferred embodiment of the present invention.

The door chime assembly of the present invention (indicated generally at 10) preferably has a housing 12, at least one chime 14, and an actuator and striker assembly 38 for striking the chime(s) 14. The housing 12 can take any shape desired, including without limitation rectangular, square, or other polygonal shapes, round, oval, or elliptical shapes, irregular shapes, and the like. The housing 12 can be made of a wide variety of materials, including without limitation metal, plastic, wood, composites, refractory materials, and the like.

In some highly preferred embodiments of the present invention such as that shown in the figures, the housing 12 has a base 16 and a removable cover 18. The cover 18 preferably encloses the door chime assembly components within the housing 12, and can be removably attached to the base 16 in a number of different manners. By way of example only, the cover 18 can be removably attached to the base 16 by one or more conventional threaded fasteners passed through matching apertures in the cover 18 and base 16, by posts in the cover 18 or base 16 mating with apertures in the base 16 or cover 18, respectively, by mating clip and aperture sets, by peripheral walls of the cover 18 snugly fitted to peripheral walls of the base 16, and the like.

In highly preferred embodiments however, the cover 18 is removably attached to the base 16 by being snap-fit thereto. Specifically, detents, holes, recesses, dimples, grooves, or other apertures in the base 16 are preferably shaped to receive bumps, fingers, ribs, ramps, pins, or other protuberances on the cover 18 (or vice versa). In the illustrated preferred embodiment, bumps 20 on the cover 18 mate with recesses 22 in the base 16 to hold the cover 18 upon the base 16. Preferably, the mating cover and base elements can be disengaged by deformation of the cover 18 and/or base 16. Such deformation can be deformation of the ramps 20, the recesses 22, or the base and cover walls on which the ramps and recesses are located. In the preferred embodiment shown in FIGS. 1–7, the cover 18 and base 16 are made of resilient plastic or metal sufficiently deformable to permit engagement and disengagement of the ramps 20 and the recesses 22 as described above. Also, optional lip portions 24 of the base 16 are preferably positioned to be seated in the interior of the cover 18 when the cover 18 is installed on the base 16. The lip portions 24 function to ease installation of the cover 18 in correct position on the base 16. Preferably, the lip portions 24 also provide a snug fit of the cover 18 upon the base 16 to help secure the cover 18 in place. As used herein and in the appended claims, the various structure, features, and elements employed to connect the cover 18 to the base 16 or other portion of the door chime assembly 10 are referred to as "fasteners".

When employed, the lip portions 24 need not necessarily extend from the base 16 or exclusively from the base 16. The lip portions 24 can instead or in addition be located on the cover 18. Also, the lip portions 24 can be located in any area on the mating edges of the cover 18 and/or the base 16, such as on the corners of the base 16 (as shown in the figures) or cover 18, on any or all of the sides of the base 16 or cover 18, or even on the entire periphery of the base 16 or cover 18.

As described above, the cover 18 of the housing 12 is preferably removable from the base 16. In other embodiments of the present invention, the cover 18 is not readily removable from the housing 12, but is movable to open and close the housing 12 for access to an acoustic chamber 26 defined by and within the housing 12 and to the door chime assembly components therein. In such embodiments, the cover 18 can be hinged to the base 16 in any conventional manner, can be pivotable with respect to the base 16 about a post, pin, or other pivot, and the like. As will be become clear from the discussion below regarding the cover 18, cover removability is preferred for purposes of changing the appearance of the door chime assembly 10.

The highly preferred door chime assembly 10 shown in FIGS. 1–7 has two chimes 14 with respective strikers 28 actuatable to strike and sound the chimes 14. However, the present invention can be practiced with more chimes 14 or as few as one chime 14, if desired. The chimes 14 are preferably metal bars as are well known to those skilled in the art, although other types of chimes made of any other material are possible. By way of example only, the chimes 14 can be tubes or rods having any cross section. Although the chimes 14 in the illustrated preferred embodiment are located fully within the housing 12, this need not necessarily be the case. The chimes 14 can extend outside of the housing 12 through one or more apertures in the housing 12.

Figure 3:
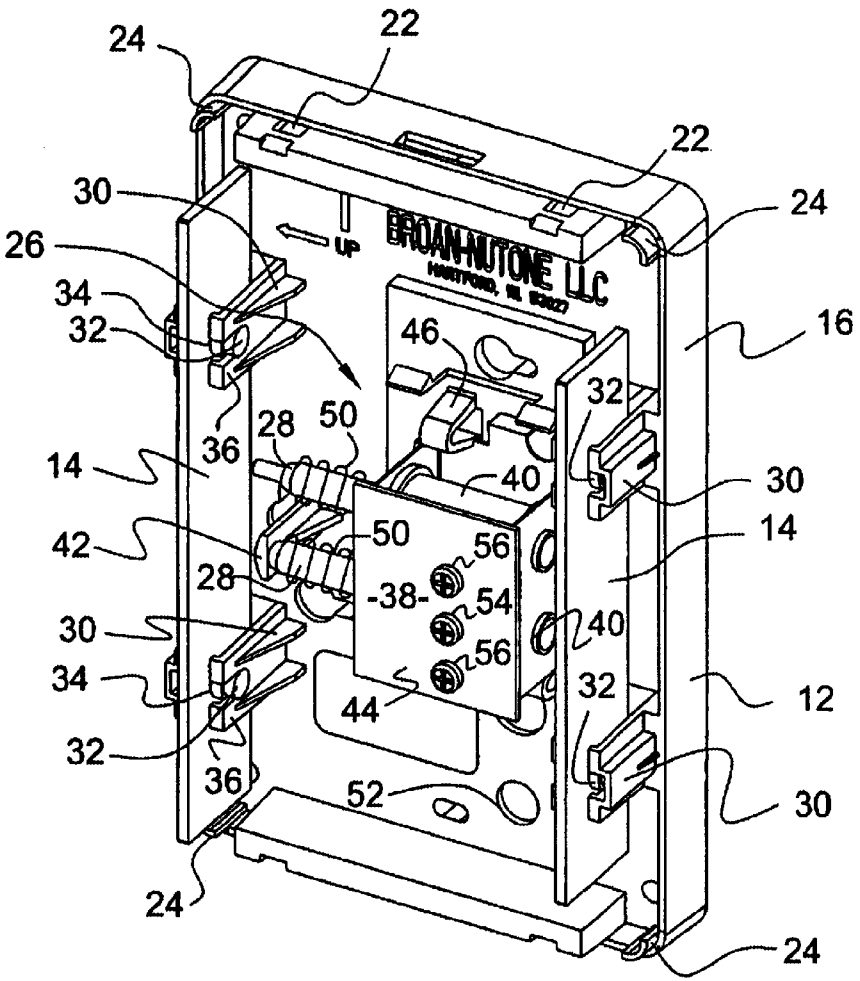
FIG. 3 is a front perspective view of the door chime assembly shown in FIGS. 1 and 2, shown with the door chime assembly cover removed.
Figure 4:
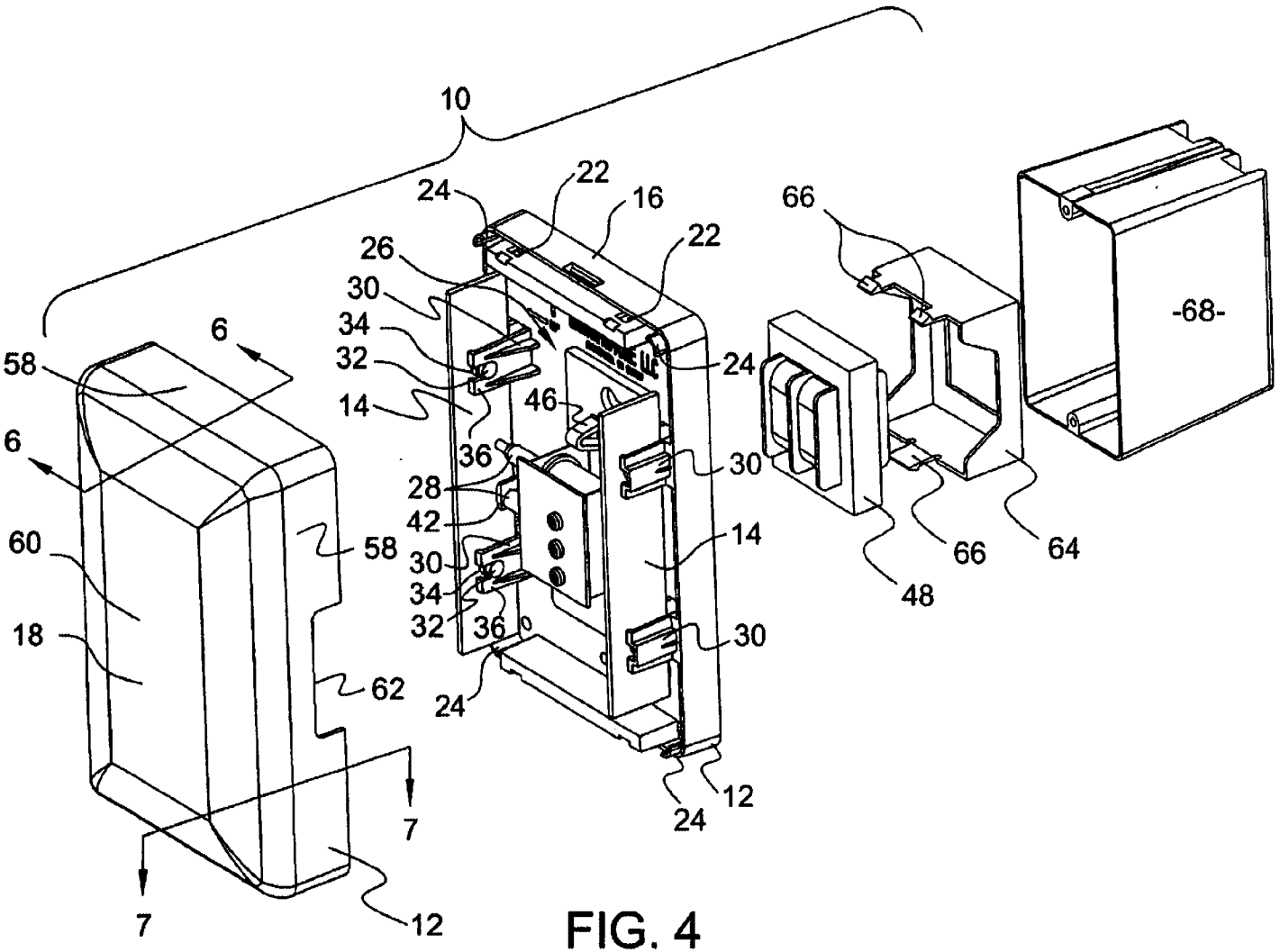
FIG. 4 is an exploded front perspective view of the door chime assembly shown in FIGS. 1–3, shown with an electrical receptacle.
Figure 5:
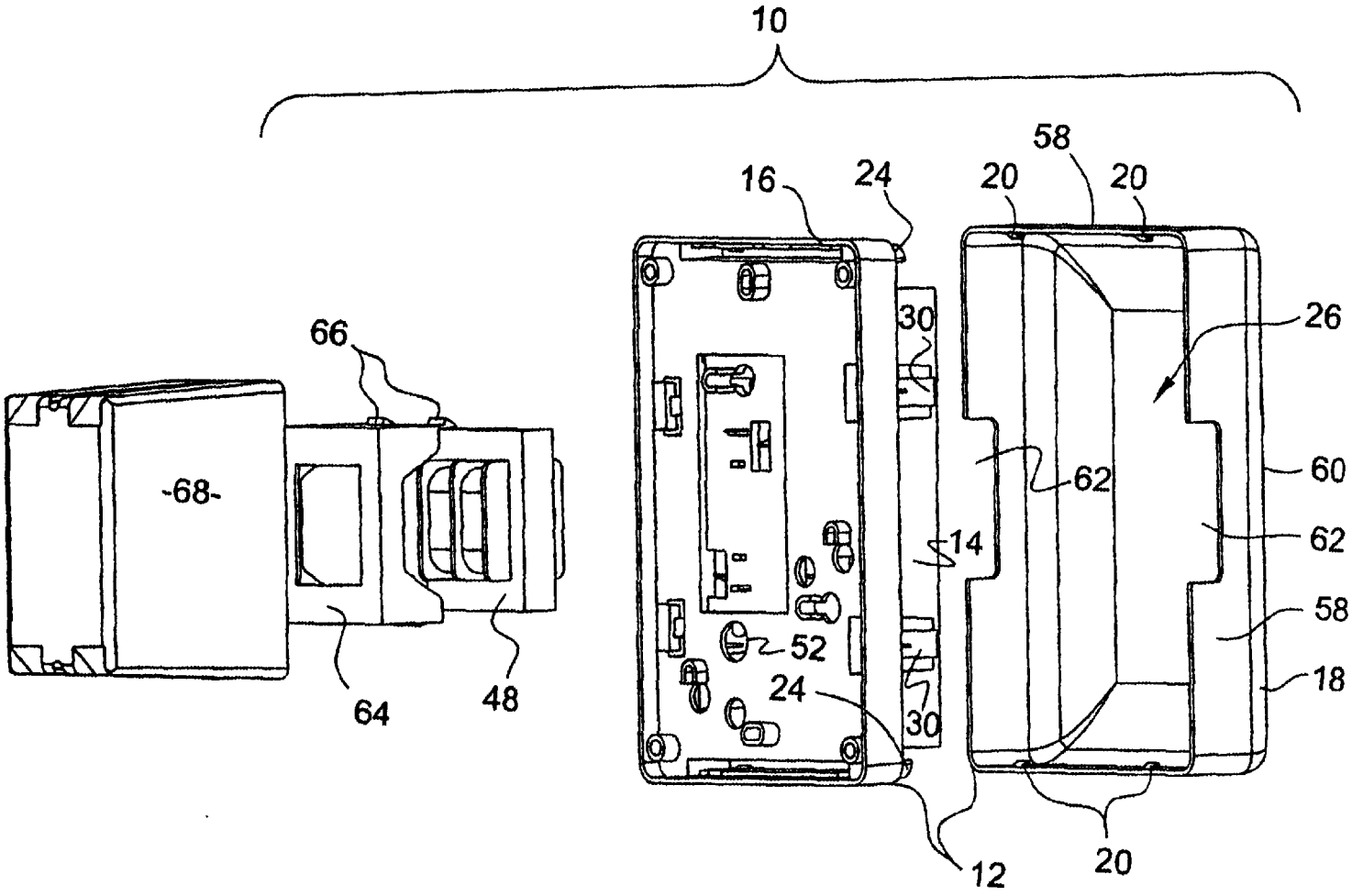
FIG. 5 is an exploded rear perspective view of the door chime assembly shown in FIGS. 1–4, shown with an electrical receptacle.
Figure 6:
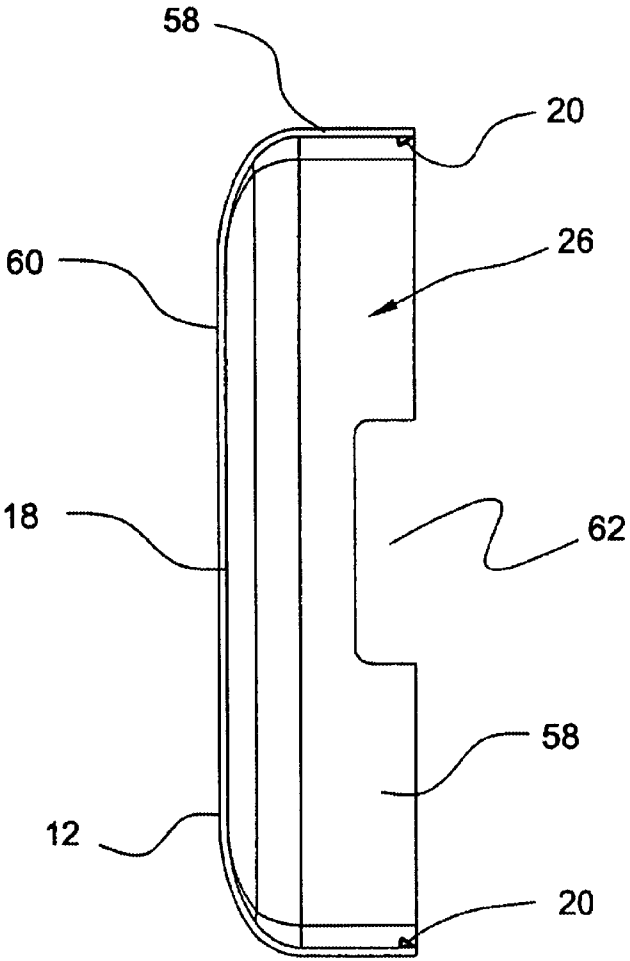
FIG. 6 is a cross-sectional side view of the door chime assembly cover shown in FIGS. 1–5, taken along lines 6—6 of FIG. 4.
Figure 7:
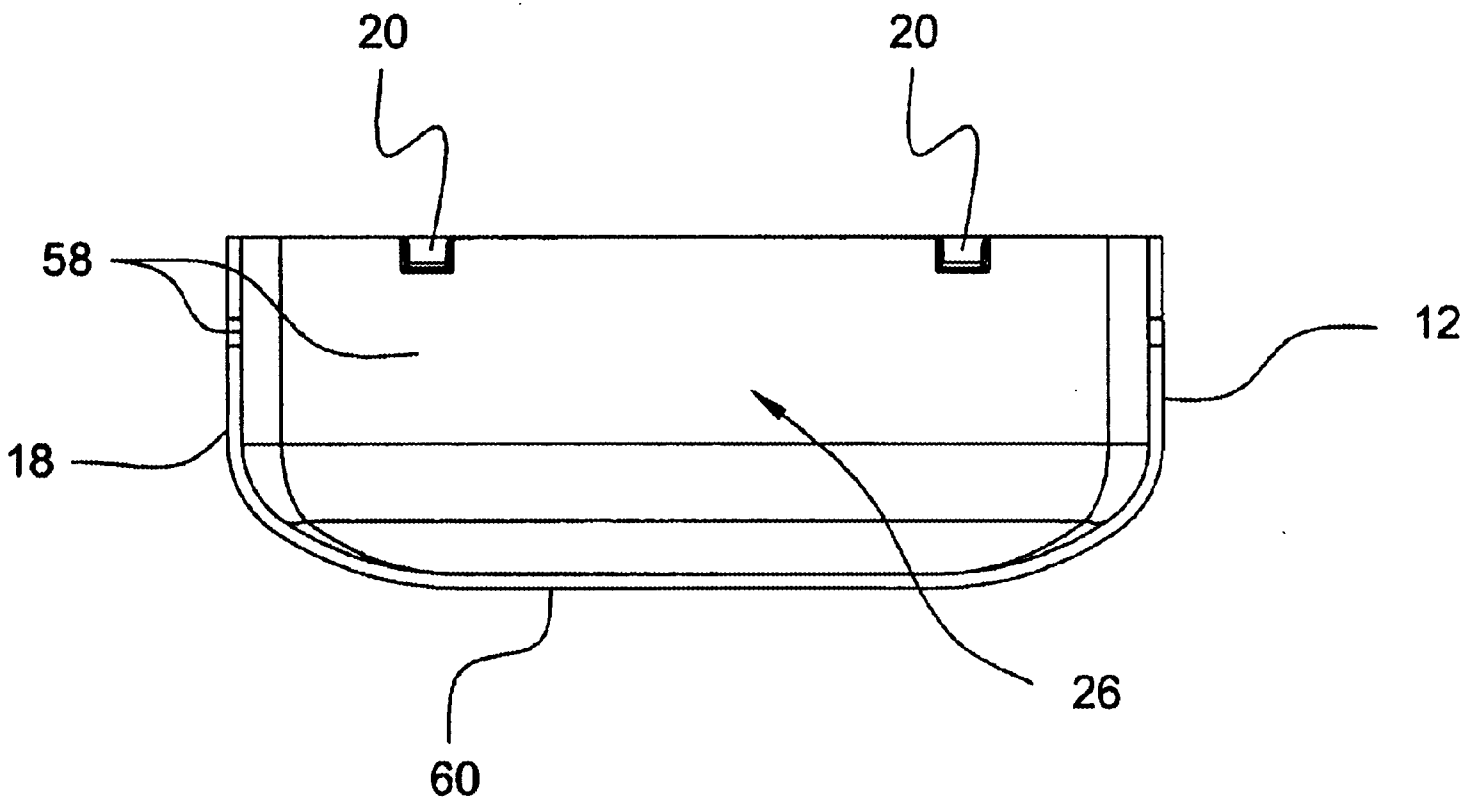
FIG. 7 is a cross-sectional side view of the door chime assembly cover shown in FIGS. 1–6, taken along lines 7—7 of FIG. 4.

With reference to FIGS. 3–5, the chimes 14 are preferably different in length to result in different chime tones when struck. As is well known to those skilled in the art, the illustrated bar-type door chimes 14 can be different in other manners to result in different chime tones. By way of example only, the chime apertures 34 (described in greater detail below) can be in different locations corresponding to alternative half-wave vibration nodes of the chimes 14. Also, differences such as chime shape (including cross-sectional shape), material, length, width, thickness, and the like can be employed to provide chimes generating different tones when struck.

The bar-type chimes 14 of the illustrated preferred embodiment are mounted within the housing 12 by chime mounts 30. The chime mounts 16 preferably extend from and are integral to the base 30. However, the chime mounts 16 can instead be separate elements connected to the base 16. For improved tone quality, the chimes 14 are held within the chime mounts 30 by conventional isolation elements 32. The isolation elements 32 are preferably made of an elastomeric material such as rubber or urethane, but can instead be made of any vibration isolating material desired. With reference to FIGS. 3–5, such isolation elements 32 can be grommets fitted within apertures 34 in the chimes 14 and within which are received posts, pins, or other elements extending from the chime mounts 30. Alternatively, and as shown in the figures, the isolation elements 32 can be plugs or pins extending through apertures or recesses in the chimes 14 and held by the chime mounts 30. In yet another embodiment, pins on the striker element can extend within grommet isolation elements 32 held by the chime mounts 30. Isolation elements, their manner of connection to chimes, and their manner of mounting to chime mounts are well known to those skilled in the art and are not therefore described further herein.

Although isolation elements 32 are most preferred, the chimes 14 in some embodiments of the present invention are mounted to chime mounts 30 without isolation elements. Also, the chimes 14 are preferably removable from the chime mounts 30 to permit easy chime replacement as needed or desired. In the illustrated preferred embodiment for example, the chimes 14 are preferably mounted upon forked chime mount ends 36. The chimes 14 can therefore be pushed into and pulled from the chime mounts 30 for fast and easy installation and removal without requiring tools. As used herein and in the appended claims, chimes 14 that can be secured in place by pressing the chimes 14 against the base 16 or against other elements connected to the base (such as the chime mounts 30 in the illustrated preferred embodiment) to engage the chimes thereon is described as having a "snap fit" with the base 16 or such other elements. Such chimes 14 are "snap fit" to the base 16 or elements connected to the base 16.

Of course, the chimes 14 can be attached to the chime mounts 30 in any conventional manner (including without limitation by threaded fasteners, clamps, welding, brazing, press-fitting, and the like) depending at least partially upon whether the chimes 14 are removable and upon the type of chimes used. In this regard, it should also be noted that the chimes 14 can be mounted in the housing 12 in a number of different conventional manners, some of which do not employ mounts such as those described above and illustrated in the figures. For example, where tube-type chimes are employed, the tubes can be suspended from pins, posts, internal housing framework, and the like. As another example, bar-type chimes can be cantilevered by being clamped at one end in any conventional manner. In short, the door chime assembly 10 of the present invention can employ any type of conventional chimes mounted in any conventional manner and located either fully or partially within the housing 12.

The actuator and striker assembly 38 of the present invention is preferably mounted to the base 16 of the housing 12 adjacent to the chimes 14. The actuator and striker assembly 38 is conventional in construction and operation, and in the illustrated preferred embodiment includes two solenoids 40 (e.g., metal coils within which are received armatures responding to magnetic fields generated by the metal coils when energized). Preferably, the armatures of the solenoids 40 are strikers 28 used for striking the chimes 14. Each striker 28 is actuatable to move and strike a corresponding chime 14 by energization of a corresponding solenoid 40. In some embodiments, one or more strikers 28 are biased by springs or other biasing elements into positions with respect to the chimes 14. For purposes of illustration in the embodiments of FIGS. 1–7, one striker 28 is biased into a retracted position by a spring 50, while the other striker 28 is biased toward another chime 14 by a second spring 50. In other embodiments, both strikers 28 are biased toward or away from their respective chimes 14 by respective springs 50. The springs 50 can be coil springs 50 located around the strikers 28 as illustrated in the figures, or can be other types of springs (e.g., leaf, torsion, and the like) attached to the strikers 28 and/or to surrounding structure of the assembly 10. A striker stop 42 (only one of which is visible in the figures) can be located adjacent to either or both strikers 28 in order to stop the striker 28 in a retracted position. The striker stops 42 can extend from the base 16 and can be integral or connected to the base 16.

The use of the preferred type of actuator and striker assembly 38 described above can (in some embodiments) permit an installer to mount the door chime assembly 10 in any orientation desired. This is in contrast to many conventional door chime assemblies that cannot operate or do not operate well in some or even most orientations as a result of gravitational force upon components within the door chime assembly. As described above, the strikers 28 can be biased toward or away from their respective chimes 14 as desired, such as by mounting springs 50 to the strikers 28. For example, in those embodiments in which both strikers 28 are biased by springs 50 into their retracted positions within the actuator and striker assembly 38, the strikers 28 are retained in such positions until actuated. In addition, the chimes 14 can also be mounted as described above to permit an installer to mount the door chime assembly 10 in any orientation. For example, the chimes 14 in the illustrated mounting arrangement are retained within their chime mounts in a secure manner (preferably by the isolation elements 32), and can therefore operate properly in any orientation.

To strike a chime 14, a solenoid 40 corresponding to that chime 14 is preferably energized, causing the striker 28 therein to move with respect to the solenoid 40. The striker 28 can be moved toward and into contact with the chime 14 or can be moved away from the chime 14 under biasing force of a spring 50 (in which case de-energization of the solenoid 40 causes the striker 28 to move into contact with the chime 14 under force from the spring 50). One striker 28 and spring 50 arrangement of each type is illustrated in FIGS. 3–7. Solenoid-actuated striker mechanisms and their manner of operation are well known to those skilled in the art and are not therefore described further herein.

It should be noted that a large number of conventional actuator and striker assemblies can be used in place of the solenoid-type actuator and striker assembly 38 described above and illustrated in the figures. These alternative actuator and striker assemblies can be manually actuated by a user-manipulatable button or lever directly or indirectly connected to the striker, can be motor-driven, can be actuated by electromagnet sets on the striker and on an adjacent housing wall or framework, and the like. Also, these alternative actuator and striker assemblies can be normally biased into a striking or retracted position in any conventional manner, such as by one or more springs, magnets, elastic members, and the like. One having ordinary skill in the art will recognize that any conventional actuator and striker assembly can be used in conjunction with the present invention and falls within the spirit and scope of the present invention.

The actuator and striker assembly 38 is preferably a single integral unit located within a frame 44 and within which the solenoids 40 are mounted. The frame 44 of the actuator and striker assembly 38 can be made of or include one or more plates as shown in FIGS. 3–5. The plates can be bent or otherwise shaped to hold the solenoids 40 in place relative to the chimes 14 and/or can be connected together in any conventional manner (such as by welding or brazing, by threaded fasteners, rivets, or other conventional fasteners, by edge tabs fitted into apertures in adjoining plates, and the like) to provide a structure for this same purpose. Alternatively, the frame 44 can include a housing, bars, rods, wire, or other elements connected together in any conventional manner to provide a structure for supporting the solenoids 40 and strikers 28 in a desired position in the housing 12.

In some preferred embodiments such as that shown in FIGS. 1–7, the frame 44 is attached to the base 16 by crimping one or more portions of the frame 44 when the frame 44 is positioned in place upon the base 16. For example, one or more tabs, fingers, pins, or other extensions (not shown) of the frame 44 can extend into and/or through apertures in the base 16 and can be crimped therein to resist removal of the frame 44 from the base 16.

In other embodiments, the frame 44 of the actuator and striker assembly 38 is attached to the base 16 of the housing 12 by at least one clip 46. Specifically, a portion of the frame 44 can preferably be engaged by one or more resilient clips 46 when the frame 44 is pressed into its place on the base 16. The clips 46 can be attached to the base 16 in any conventional manner, but are more preferably stamped, pressed, cut, or otherwise formed from the base 16 itself. For example, in one preferred embodiment, two clips 46 integral to the base 16 flank the actuator and striker assembly 38 and are hook-shaped to retain the frame 44 thereof upon the base 16 once engaged by the clips 46. Although hook-shaped clips 46 are preferred in such embodiments, the clips 46 can take any shape capable of deforming to accommodate movement of the frame 44 to its position on the base 16 and of retaining the frame 44 once in place. More generally, the frame 44 can engage tabs, raised walls or ribs, pins, or any other structure performing these same functions. As used herein and in the appended claims, an actuator and striker assembly 38 that can be secured in place by pressing the actuator and striker assembly 38 against the base 16 to engage the clips 46 or such other structure mentioned above is described as having a "snap fit" with the base 16. Such an actuator and striker assembly 38 is "snap fit" to the base 16. The clips 46 and alternative elements just described permit quick and easy installation of the actuator and striker assembly 38 without tools or fasteners and without the need to assemble the actuator and striker assembly 38 on the base 12. This results in faster, more efficient, and less expensive assembly of the present invention.

In other embodiments of the present invention, the frame 44 of the actuator and striker assembly 38 is attached to the base 16 in any conventional manner, such as by screws, rivets, or other conventional fasteners, by welding or brazing, by inter-engaging elements on the frame 44 and base 16, and the like. The frame 44 can even be stamped, pressed, cut, or otherwise formed from the base 16 itself, in which case the solenoids 40 and strikers 28 would have to be installed in the frame 44 rather than being pre-assembled and installed as a single integral unit.

The preferred door chime assembly illustrated in the figures has two chimes 14 and an actuator and striker assembly 38 with two strikers 28 and two actuators (solenoids) 40. This number of chimes 14, strikers 28, and actuators 40 is only presented by way of illustration. Any number of chimes 14, strikers 28, and actuators 40 can be used in the present invention. Also, the number of chimes 14 need not necessarily correspond to the number of strikers 28 and actuators 40. Specifically, depending at least in part upon the type of actuator and striker assembly used, one striker 28 can be used to selectively strike one or more different chimes 14 in the assembly 10. By way of example only, some conventional actuator and striker mechanisms employ a solenoid controllable to move a striker to two opposing positions depending upon the manner in which the solenoid is energized. Accordingly, different actuator and striker assemblies controllable to strike any number of different chimes are possible and fall within the spirit and scope of the present invention.

Figure 2:
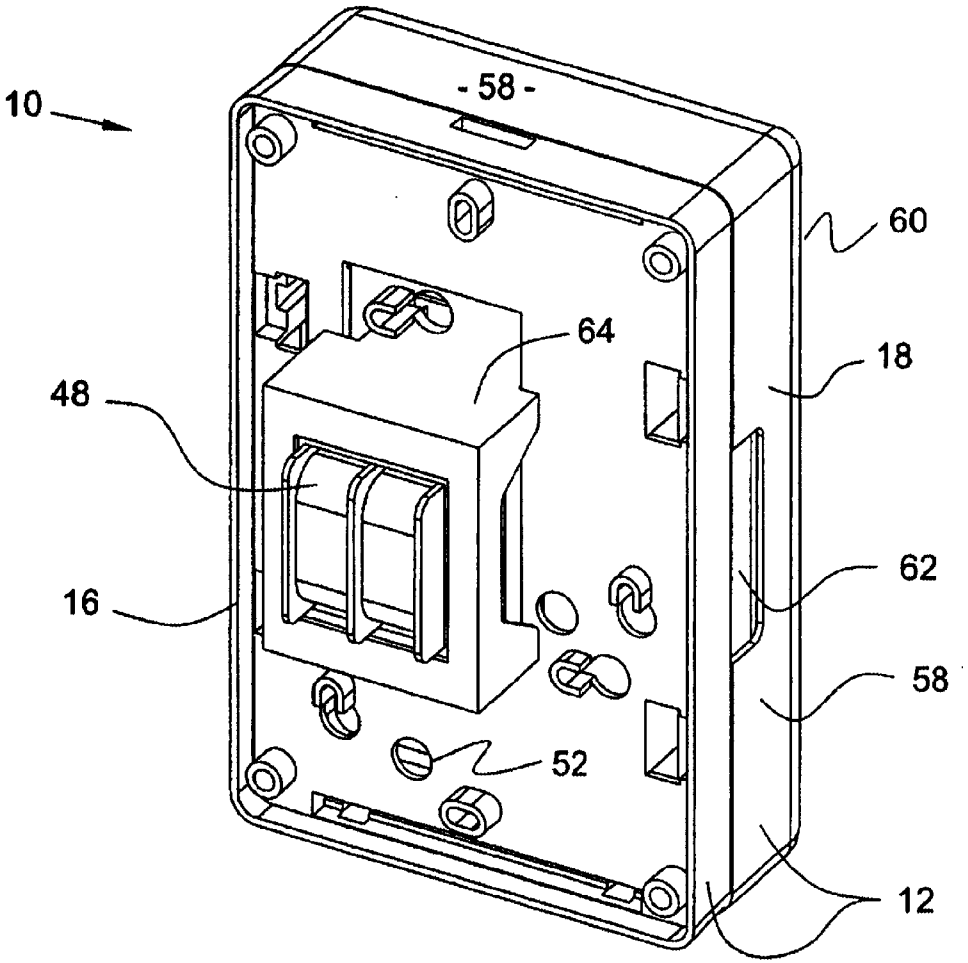
FIG. 2 is a rear perspective view of the door chime assembly shown in FIG. 1.

Some highly preferred embodiments of the present invention include a transformer 48 mounted to the housing 12. Most preferably, the transformer 48 is mounted to the base 16 of the housing 12 as shown in the figures. In order to conform to the requirements of many electric codes, the transformer 48 and any high-voltage wiring leading thereto must be shielded from the low-voltage actuator and striker assembly 38 and the low-voltage wiring leading thereto. Therefore, the transformer 48 is preferably mounted to a side of the base 16 opposite the actuator and striker assembly 38 and its associated low-voltage wiring. Most preferably, the transformer 48 is mounted to the base 16 on the outside of the housing 12 as best shown in FIGS. 2 and 5. Some transformers 48 include and are substantially or fully enclosed within a transformer housing. In such cases, one or more walls of the transformer housing can perform the wiring separation function described above, whether alone or in conjunction with a wall of the base 16. The transformer 48 can be mounted to the base 16 by one or more fasteners, such as screws, rivets, pins, clips, and the like, or can be attached thereto in any other manners desired, such as by one or more inter-engaging elements on the transformer 48 and base 16, by crimping or snap-fitting the transformer 48 to the base 16, and the like.

Although not required, some embodiments of the present invention employ a transformer cover 64 which partially or fully encloses the transformer 48 on the base 16. The transformer cover 64 can have any shape and size desired capable of performing this function. The transformer cover 64 can be attached to the base 16 in any of the manners described above with reference to the attachment of the transformer 48 to the base 16, and in some preferred embodiments is attached to the base 16 by one or more clips 66 received within apertures in the base 16. Most preferably, the transformer cover 64 is snap-fit to the base 16 in this or in other manners.

As an alternative to connecting the transformer 48 directly to the base 16 as described above, the transformer 48 can instead be retained in position at or adjacent to the base 16 by the transformer cover 64, which itself can be connected to the base 16 as also described above. This manner of assembly can, in some embodiments, permit the transformer 64 to be connected to the base 16 without the use of tools (e.g., where the transformer cover 64 is snap-fit to the base 16), thereby streamlining and simplifying assembly of the door chime assembly 10.

In some preferred embodiments, the transformer 48 (or the transformer 48 and transformer cover 64, if used) is shaped and sized to be received within a standard-sized electrical box 68, such as those used for wall outlets. By mounting the transformer 48 to the door chime assembly 10 as discussed above, the door chime assembly 10 and the transformer 48 can be installed in a wall or other surface as a single integral unit or assembly, and can even be installed within an electrical box 68 in the wall or other surface already provided with power wires. Therefore, the installer need only run doorbell wire from the door chime assembly 10 to the doorbell(s) rather than also running low-voltage power wire from the location of the door chime assembly 10 to a remote transformer and running higher-voltage power wire from the transformer to a power source or circuit breaker box. The present invention can therefore greatly simplify and speed the process of door chime assembly installation. In some applications such as in older homes and structures where a powered electrical box already exists, the door chime installation process according to the present invention can be reduced to connecting the transformer wires (e.g., two power wires and a ground wire in most applications) to the wires in the electrical box, running doorbell wire to the doorbell buttons, and securing the housing 12 and/or transformer in place.

Alternatively, the transformer 48 can first be wired and mounted within an electrical box 68, after which time the door chime assembly 10 can be wired and mounted to the transformer 48. Such a manner of installation has advantages over first mounting the transformer 48 to the base 16 and then installing the transformer 48 and base 16 as an integral unit as described above. For example, in new construction, the high-voltage electrical connections can be made by one party (such as an electrician), leaving the selection and installation of the rest of the door chime assembly 10 to another party (such as a homeowner). As another example, this manner of installation can simplify the replacement of an existing door chime assembly 10 without the need to disconnect and connect high-voltage wires running to the transformer 48.

In those embodiments of the present invention where the transformer 48 is mounted to the housing 12, and more preferably is mounted to the base 16 of the housing 12, the transformer 48 can be connected to the actuator and striker assembly 38 by suitable power wiring extending from the transformer 48 to the actuator and striker assembly 38 through one or more apertures 52 in the housing 12. In the illustrated preferred embodiment for example, two low-voltage power wires are passed from the transformer 48 mounted upon the rear side of the base 16, through an aperture 52 in the base 16 and to the actuator and striker assembly 38. One having ordinary skill in the art will appreciate that other manners exist for electrically connecting the transformer 48 and the actuator and striker assembly 38 while isolating the transformer 48 and its high-voltage wiring from the low-voltage wiring of the actuator and striker assembly 38. Each of such alternative manners of connections falls within the spirit and scope of the present invention. By way of example only, the transformer 48 and the actuator and striker assembly 38 can be connected to and located on opposite sides of a power bus or power board which electrically connects the transformer 48 to the actuator and striker assembly 38.

The low-voltage power wire(s) from the transformer 48 are preferably connected to the actuator and striker assembly 38 in any conventional manner. For example, and with reference to FIG. 3, the wires running from the transformer 48 can be connected to an electrical connector 54 (e.g., a screw contact) located on the frame 44 of the actuator and striker assembly 38. In such a case, the part of the frame 44 upon which the electrical connector 54 is mounted is preferably made of an insulative material such as plastic or ceramic. Alternatively or in addition, the electrical connector 54 can be mounted to the actuator and striker assembly 38 by one or more mounts made of electrically insulative material. In other embodiments, the electrical connector 54 can be a wire socket, wire clip, and the like. Alternatively, wires can extend from the actuator and striker assembly 38 for connection to the wires extending from the transformer 48 by any wire splicing method or device.

In order to connect one or more user-manipulatable controls (such as doorbell buttons) to the actuator and striker assembly 38, the wires extending from such controls can be passed through one or more apertures 52 in the housing 12 for connection to one or more electrical connectors 56 on or connected to the actuator and striker assembly 38. The aperture 52 can be the same or a different aperture used to run the low-voltage power wiring from the transformer 48 to the actuator and striker assembly 38. The electrical connectors 56 can take any form desired such as those described above with reference to the transformer electrical connector 54.

Although the transformer is preferably mounted outside of the housing 12 as illustrated in the figures (and more preferably is mounted to a rear side of the base 16 of the housing 12), in other embodiments the transformer 48 can be mounted within the housing 12. However, in such cases, the transformer 48 is preferably enclosed by internal walls within the housing 12 in order to separate high-voltage wiring from low-voltage wiring in the assembly 10.

It should be noted that the transformer 48 can be received by the installer already connected to the actuator and striker assembly 38 as described above. The transformer 48, housing 12 and elements located within the housing 12 are therefore all received and can be installed as a single integral unit. Alternatively, the transformer 48 can be received as a separate element for connection by an installer to the actuator and striker assembly 38 in any of the manners described above.

According to some preferred embodiments of the present invention, the door chime assembly 10 can be assembled and installed by mounting the transformer 48 to the base 16 from a rear side of the base 16, mounting the chime(s) 14 and the actuator and striker assembly 38 from a front side of the base 16 (e.g., with the front side of the base 16 facing toward the assembler), and connecting the housing cover 18 to the base 16 from the front side of the base 16. Preferably, the wires extending from the user-manipulatable controls and/or from the transformer 48 can also be connected to the actuator and striker assembly 38 from the front side of the base 16. In some applications, it is highly desirable to assemble and connect as many of the elements of the door chime assembly 10 from the front side of the base 16 as possible without the need for access from the rear of the door chime assembly 10. For example, in those cases where the door chime assembly 10 is already be mounted in a desired location, access to the rear of the base 16 may be limited. Even in embodiments in which the door chime assembly 10 has not yet been mounted in a desired location, assembly of as many components as possible from one side of the door chime assembly 10 simplifies and streamlines the assembly process to save time and money. In a number of embodiments of the present invention as described above, the arrangement of the transformer 48, chime(s) 14, actuator and striker assembly 38, and the wires extending from the user-manipulatable controls (not shown) and transformer 48 into the housing 12 and to the actuator and striker assembly 38 enable fast and easy assembly and installation of the door chime assembly 10 in this manner.

Typically, tone quality and resonance are important aspects of a door chime assembly. In the present invention, the inventor has discovered that certain features of the door chime assembly housing 12 produce tone quality and resonance superior to conventional door chime assemblies. These features include the use of a domed or tented surface of the housing cover 18, cutouts in the sides of the housing cover 18, and an open internal acoustic chamber 26 that is occupied only by actuator and striker assembly 38 and the chimes 14 and chime mounts 30 (rather than being separated into two or more chambers by internal walls).

An example of a housing cover 18 according to the present invention is best illustrated in FIGS. 4–7. Although any housing cover shape can be employed with the other features and elements of the present invention as described above, the housing cover 18 more preferably has a domed or tented inner surface extending away from the base 16. As used herein and in the appended claims, the terms "domed" and "tented" only refer to housing cover shapes that have a curved top portion (whether defining an entire top surface of the housing cover 18 or only curved edges between side walls and a top wall of the housing cover 18 as illustrated in the figures) or housing cover shapes that are otherwise elevated with increased inner distance from the side walls 58 of the housing cover 18.

In some highly preferred embodiments, the housing cover 18 has a polygonal shape defined by side walls 58 extending away from the base 16 and has a top wall 60 which meets the side walls 58 at curved edges and corners. By way of example only, the housing cover 18 is rectangular and is defined by four side walls 58 extending from the base 16 to the top wall 60. In this and in other embodiments, excellent tone quality and resonance results have been achieved when the curved interface between the top wall 60 and the side wall(s) 58 has a radius of curvature greater than 0.5 inches. More preferably, this radius of curvature is not less than 1 inch.

The inventor has also found that superior tone quality and resonance is produced when apertures 62 are located in the side walls of the housing cover 18. The apertures 62 can be defined only by the housing cover 18 or can instead be defined by the housing cover 18 and by the base 16 (such as in the illustrated preferred embodiment, in which the apertures 62 are recesses in the side walls 58 of the housing cover 18 and each have a side defined by the base 16). The apertures 62 can be any size and shape, but preferably are at least 0.5 square inches in size in order to permit the escape of sound from the housing 12. Apertures having a size greater than or equal to about 1 square inch produce excellent results. In some preferred embodiments, apertures 62 of 1 square inch or greater produce good results.

Any number of apertures 62 can be employed in the housing 12 of the present invention. In some preferred embodiments however, the housing 12 has at least one aperture 62 for each chime 14 in the door chime assembly 10. With reference to the illustrated preferred embodiment, for example, the housing 12 preferably has an aperture 62 for each of the two chimes 14. More preferably, each aperture 62 is located in the housing 12 adjacent to a corresponding chime 14, thereby permitting sound from each chime 14 to resonate in the acoustic chamber 26 and to exit from a corresponding aperture 62 adjacent to the chime 14. Each aperture 62 is preferably located adjacent to a face of a corresponding chime 14 (rather than an edge or end), although the apertures 62 can be located in different positions with respect to the chimes 14, if desired. In some embodiments, the inventor has also discovered that improved tone quality and resonance can be achieved by placing the chimes 14 adjacent to the side walls 58 and between the apertures 62 and the center of the acoustic chamber 26 as shown in the figures.

As mentioned above, an open internal acoustic chamber 26 is highly desirable in some embodiments of the present invention in order to improve the sound quality of the door chime assembly 10. Conventional door chime assemblies typically have multiple chambers 26 located within a frame or housing and defined by one or more internal walls or similar barriers. In some existing door chime assemblies, the internal walls or barriers define a chamber for each chime of the door chime assembly. In contrast, the acoustic chamber 26 in some preferred embodiments of the present invention is preferably open and unobstructed (with the exception of the actuator and striker assembly 38 and the chimes 14 and chime mounts 30), and has no walls to block the movement and resonance of sound waves.

As mentioned above, conventional door chime assemblies cannot be readily changed in operation or appearance by a consumer or installer. Therefore, when the external appearance or the sounds made by the chimes of a door chime assembly are no longer desirable, the entire assembly must typically be replaced. In some preferred embodiments of the present invention, this shortcoming is addressed by the use of a universal base 16 to which either of two or more standardized housing covers 18 can be connected. Specifically, two or more housing covers 18 having different shapes, sizes, and appearances preferably share the same mounting structure used to connect the housing covers 18 to the base 16 so that any of the different housing covers 18 can be releasably attached to the base 16.

In the illustrated preferred embodiment for example, the mounting structure used to connect the housing cover 18 to the base 16 includes the recesses 22 and ramps 20 on the base 16 and cover 16, respectively, and can also include the lip portions 24 on the base 16 as described above. Because other housing covers 18 having the same or similar mounting structure can have entirely different shapes, sizes, and appearances (while still preferably fitting over the internal components of the door chime assembly 10), a user can select from two or more housing covers having different styles for attachment to the base 16. The housing covers 18 can be different in color or texture, have different surface features, be different in shape or size, and the like. Therefore, a user can select the housing cover 18 that suits his or her taste in the installation of a new door chime assembly 10 or for replacement of a housing cover 18 with a different housing cover 18 without the need to replace the entire door chime assembly 10.

Although the different covers 18 that can be employed with a universal base 16 preferably use the same mounting structure and mounting locations on the universal base 16, this is not required to practice the present invention. Specifically, one or more of the different covers can connect to the same base 16 at different locations and in different manners as desired and/or as determined by the shape, size, and style of the covers.

In those embodiments of the present invention having two or more covers 18 that can be mounted upon the same base 16, the covers 18 preferably share the same or similar interior shapes in order to maintain the same or similar acoustic chamber shape and size (and therefore the same or similar acoustic properties). In some embodiments however, one or more covers 18 can have different internal shapes selected to change the acoustic properties of the door chime assembly. By way of example only, covers with different internal shapes can have different resonating abilities and can therefore be louder or quieter or can have longer or shorter resonating times as desired. As another example, covers having different internal shapes can be selected to change the tonal quality of the chimes 14, such as for making the chime sounds more crisp, softer, and the like.

An alternative manner in which to change the appearance of the door chime assembly 10 according to the present invention is to employ the same housing cover 18 as described above but to provide two or more different facades (not shown), each of which is attachable to the housing cover 18. The facades can be releasably attached to the housing cover 18 in a number of different manners, such as by one or more threaded fasteners, clamps, clips, buckles, or pin and aperture sets, by a snap fit between the facade and the housing cover 18, by a press fit or snug fit of the facade upon the housing cover 18, and the like. In some embodiments for example, a facade can have walls on a side facing the housing cover 18 which partially or fully surround the housing cover 18 in a snug manner. As another example, the facade can have one or more clips integrally formed with the facade or connected thereto in any conventional manner which engage with the edges of the housing cover 18, with apertures, detents, grooves, or recesses in the housing cover, and/or with other clips, lips, fingers, ledges, ribs, or other protrusions on the housing cover 18, and the like. In other examples, the facade can be attached by one or more screws passed through apertures in the facade and into aligned threaded apertures in the housing cover 18. Still other manners of releasably attaching a facade to the housing cover 18 are possible, each of which fall within the spirit and scope of the present invention. Such releasable facade attachment permits a user to select the housing facade that suits his or her taste in the installation of a new door chime assembly 10 or for replacement of a facade with a different facade without the need to replace the entire door chime assembly 10 and/or housing cover 18.

Although the different facades that can be attached to the housing cover 18 preferably use the same mounting structure and mounting locations on housing cover 18, this is not required to practice the present invention. Specifically, one or more of the different facades can connect to the same housing cover 18 at different locations and in different manners as desired and/or as determined by the shape, size, and style of the facades.

The housing cover 18 of the door chime assembly 10 is preferably removable in order to provide a number of the advantages discussed above (i.e., those related to cover replacement and interchangeability). However, it should be noted that a number of features of the present invention do not call for or require a removable housing cover 18. By way of example only, the above-described housing cover internal shapes for producing improved sound quality and tone can be employed regardless of whether the housing cover 18 is removable. As another example, a door chime assembly 10 according to the present invention need not employ a removable housing cover 18 in order to provide the advantages of a transformer 48 mounted to the housing 12 as described above. In some alternative embodiments of the present invention, the housing cover 18 is permanently connected to the base 16 and may or may not provide access to the interior of the door chime assembly 10. For example, the housing cover 18 can be mounted to the base or to another portion of the housing 12 by one or more hinges, pivots, slides, and the like in order to provide access to the interior of the door chime assembly 10 while still being permanently connected to the base 16. Alternatively, the housing cover 18 can be an integral part of the base 16. In either case, other types of access are possible for assembly or repair of the door chime assembly 10, such as access apertures in the housing 12, one or more removable panels in the housing 12, and the like. In some embodiments, the housing 12 can be manufactured to provide no access to the interior at all.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. For example, the various elements and components described with reference to the illustrated preferred embodiment are all mounted to the base 16. One having ordinary skill in the art will appreciate that any or all of the components can be permanently or releasably mounted to other parts of the housing 12 (such as to the side walls 58, to the cover 18, or to any other portion of the housing 12).

It should be noted that throughout the appended claims, when one element is said to be "coupled" to another, this does not necessarily mean that one element is fastened, secured, or otherwise attached to another element. Instead, the term "coupled" means that one element is either connected directly or indirectly to another element or is in mechanical or electrical communication with another element. Examples include directly securing one element to another (e.g., via welding, bolting, gluing, frictionally engaging, mating, etc.), elements which can act upon one another (e.g., via camming, pushing, or other interaction), one element imparting motion directly or through one or more other elements to another element, and one element electrically connected to another element either directly or through a third element.

We claim:

1. A door chime assembly, comprising:

a housing having a base;

a cover coupled to the base; and at least one housing wall;

a chime at least partially located within the housing;

a striker movable to strike the chime;

an actuator coupled to the striker and actuatable to move the striker;

a transformer mounted upon the housing to define a transformer and housing unit of the door chime assembly, the transformer electrically coupled to the actuator, and isolated from the actuator by the at least one housing wall; and a user-manipulatable control coupled to the actuator to trigger actuation of the striker.

2. The door chime assembly as claimed in claim 1, wherein the base defines the at least one housing wall.

3. The door chime assembly as claimed in claim 2, wherein the transformer and the actuator are mounted on opposite sides of the at least one housing wall.

4. The door chime assembly as claimed in claim 1, further comprising:

high-voltage wiring coupled to the transformer and supplying power to the transformer; and low-voltage wiring coupled to the actuator and supplying power to the actuator, wherein the at least one housing wall substantially separates the high-voltage wiring from the low-voltage wiring.

5. The door chime assembly as claimed in claim 1, wherein the actuator comprises a metal coil within which the striker is movably received.

6. The door chime assembly as claimed in claim 1, wherein the actuator, chime, and cover are snap-fit to the base.

7. A door chime assembly, comprising:

a housing having a base;

a cover coupled to the base; and a chime at least partially located within the housing;

a striker movable to strike the chime;

an actuator coupled to the striker and actuatable to move the striker;

a transformer mounted upon the housing to define a transformer and housing unit of the door chime assembly, the transformer electrically coupled to the actuator;

a transformer housing at least partially enclosing the transformer, the transformer isolated from the actuator by the transformer housing; and a user-manipulatable control coupled to the actuator to trigger actuation of the striker.

8. The door chime assembly as claimed in claim 7, wherein the transformer is also isolated from the actuator by the base.

9. The door chime assembly as claimed in claim 7, wherein the transformer and the actuator are mounted on opposite sides of the base.

10. The door chime assembly as claimed in claim 7, further comprising:

high-voltage wiring coupled to the transformer and supplying power to the transformer; and low-voltage wiring coupled to the actuator and supplying power to the actuator, wherein the transformer housing substantially separates the high-voltage wiring from the low-voltage wiring.

11. A door chime assembly, comprising;

a housing having a base;

a first cover removably coupled to the base; and an acoustic chamber defined at least partially by the base and the first cover;

a chime located at least partially within the acoustic chamber;

an actuator;

a striker coupled to the actuator and movable thereby to strike the chime;

a user-manipulatable control electrically coupled to the actuator and;

a transformer mounted upon the housing, supplied with power via high-voltage wiring, and electrically coupled to the actuator;

the housing adapted to be removably coupled to at least one other cover different in appearance from the first cover, wherein the transformer and housing define a transformer and housing unit of the door chime assembly.

12. The door chime assembly as claimed in claim 11, wherein the first cover and the at least one other cover are removably couplable to the base by at least one common fastener.

13. The door chime assembly as claimed in claim 11, wherein the first cover and the at least one other cover are removably couplable to the base by snap-fitting to the base.

14. The door chime assembly as claimed in claim 11, wherein the first cover and the at least one other cover have substantially identical internal shapes partially defining the acoustic chamber when coupled to the base.

15. The door chime assembly as claimed in claim 11, wherein the transformer and the actuator are separated by at least one housing wall.

16. The door chime assembly as claimed in claim 15, wherein the at least one housing wall is defined by the base.

17. The door chime assembly as claimed in claim 11, wherein the housing is mountable for operation in any orientation.

18. A method of assembling a door chime assembly, comprising:

providing a base having substantially oppositely-facing front and rear sides;

coupling a transformer to the rear side of the base to define a transformer and base unit of the door chime assembly;

orienting the front side of the base substantially toward an installer;

coupling a chime to the base solely from the front side of the base;

coupling an actuator and striker assembly to the base solely from the front side of the base;

electrically coupling the transformer to the actuator solely from the front side of the base; and coupling a cover to the base solely from the front side of the base.

19. The method as claimed in claim 18, further comprising:

inserting the transformer into an electrical receptacle; and coupling the door chime assembly to the electrical receptacle.

20. The method as claimed in claim 19, wherein inserting the transformer into the electrical receptacle occurs before coupling the transformer to the rear side of the base.

21. The method as claimed in claim 19, wherein inserting the transformer into the electrical receptacle occurs after coupling the transformer to the rear side of the base.

22. The method as claimed in claim 18, wherein coupling the chime and the actuator and striker assembly to the base includes snap-fitting the chime and the actuator and striker assembly to the base.

23. The method as claimed in claim 22, wherein coupling the cover to the base includes snap-fitting the cover to the base.

24. The method as claim 18, further comprising coupling a user-manipulatable control to the actuator.

25. The method as claimed in claim 18, further comprising coupling a user-manipulatable control to the actuator solely from the front side of the base.

26. The method as claimed in claim 18, wherein the actuator and striker assembly and the transformer are located on opposite sides of a housing wall.

27. The method as claimed in claim 26, wherein the housing wall is defined by the base.

28. The method as claimed in claim 18, further comprising shielding high-voltage wiring to the transformer from low-voltage wiring to the actuator and striker assembly by at least one housing wall.

29. The method as claimed in claim 28, wherein the at least one housing wall is a wall of the base.

30. A method of assembling a door chime assembly, comprising:

coupling a chime to a base having at least one wall;

coupling an actuator and striker assembly to the base;

coupling a transformer to the base on a side of the at least one wall opposite the chime to define a transformer and base unit of the door chime assembly;

shielding the transformer from the actuator and striker assembly with the at least one wall; and coupling a cover to the base to at least partially enclose the chime within a chamber defined by the cover and the base.

31. The method as claimed in claim 30, further comprising:

inserting the transformer into an electrical receptacle; and coupling the door chime assembly to the electrical receptacle.

32. The method as claimed in claim 31, wherein inserting the transformer into the electrical receptacle occurs before coupling the transformer to the base.

33. The method as claimed in claim 31, wherein inserting the transformer into the electrical receptacle occurs after coupling the transformer to the base.

34. The method as claimed in claim 30, wherein coupling the chime and the actuator and striker assembly to the base includes snap-fitting the chime and the actuator and striker assembly to the base.

35. The method as claimed in claim 30, further comprising:

coupling a high-voltage power line to the transformer;

coupling the transformer to the actuator and striker assembly with a low-voltage power line; and shielding the high-voltage power line from the low-voltage power line with the at least one wall.

36. The method as claimed in claim 30, further comprising coupling a user-manipulatable control to the actuator and striker assembly.

37. The method as claimed in claim 36, further comprising shielding electrical wiring associated with the user-manipulatable control from electrical wiring associated with the transformer with the at least one wall.

38. A method of assembling a door chime assembly, comprising:

providing a base;

snap-fitting an actuator and striker assembly to the base without the use of tools;

snap-filling at least one chime to the base without the use of tools;

snap-fitting a cover to the base without the use of tools; and snap-fitting a transformer to the base without the use of tools to define a transformer and base unit of the door chime assembly.

39. The method as claimed in claim 38, wherein the transformer is snap-fit to the base by snap-fitting a transformer cover to the base.

40. The method as claimed in claim 38, wherein snap-fitting the at least one chime to the base includes snap-fitting the at least one chime to at least one chime mount extending from the base.

41. The method as claimed in claim 38, wherein the snap-fitting steps are all performed from one side of the base without access to an opposite side of the base.

42. The method as claimed in claim 41, further comprising electrically coupling a transformer to the actuator and striker assembly from the one side of the base without access to the opposite side of the base.

43. A door chime assembly, comprising:

a base;

an actuator and striker assembly coupled to the base by a snap-fit connection;

at least one chime coupled to the base by a snap-fit connection;

a cover coupled to the base by a snap-fit connection;

a transformer electrically coupled to the actuator and striker assembly, wherein the transformer is coupled to the base by a snap-fit connection to define a transformer and base unit of the door chime assembly; and a user-manipulatable control electrically coupled to the actuator and striker assembly.

44. The door chime assembly as claimed in claim 43, further comprising at least one chime mount extending from the base, wherein the at least one chime is coupled to the base by a snap-fit connection to the at least one chime mount.

45. The door chime assembly as claimed in claim 43, wherein the actuator and striker assembly, the at least one chime, and the cover are all accessible solely from a front side of the base.

* * * * *